US011128026B2

(12) United States Patent
Kang et al.

(10) Patent No.: US 11,128,026 B2
(45) Date of Patent: Sep. 21, 2021

(54) MULTI-DIVISIONAL ANTENNA

(71) Applicant: KMW INC., Hwaseong-si (KR)

(72) Inventors: Seong-man Kang, Hwaseong-si (KR); Inho Kim, Hwaseong-si (KR); Hyoung-seok Yang, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 365 days.

(21) Appl. No.: 15/992,149

(22) Filed: May 29, 2018

(65) Prior Publication Data

US 2018/0277923 A1 Sep. 27, 2018

Related U.S. Application Data

(63) Continuation of application No. PCT/KR2016/013758, filed on Nov. 28, 2016.

(30) Foreign Application Priority Data

Nov. 30, 2015 (KR) ..... 10-2015-0168939

(51) Int. Cl.

| | |
|---|---|
| ***H01Q 1/12*** | (2006.01) |
| ***H01Q 1/24*** | (2006.01) |
| ***H01Q 1/52*** | (2006.01) |
| ***H01Q 21/00*** | (2006.01) |

(52) U.S. Cl.

CPC ..... *H01Q 1/1242* (2013.01); *H01Q 1/1207* (2013.01); *H01Q 1/1228* (2013.01); *H01Q 1/246* (2013.01); *H01Q 1/52* (2013.01); *H01Q 21/0006* (2013.01)

(58) Field of Classification Search

CPC .... H01Q 1/1207; H01Q 1/246; H01Q 1/1242; H01Q 1/52; H01Q 21/0006; H01Q 1/1228

See application file for complete search history.

(56) References Cited

U.S. PATENT DOCUMENTS

| | | | | |
|---|---|---|---|---|
| 2005/0121259 | A1 | 6/2005 | O'Shea | |
| 2005/0134512 | A1* | 6/2005 | Gottl | H01Q 1/246 343/757 |
| 2005/0205281 | A1* | 9/2005 | Bachinski | H02G 3/088 174/50 |

(Continued)

FOREIGN PATENT DOCUMENTS

| | | |
|---|---|---|
| CN | 201966329 U | 9/2011 |
| CN | 204596939 U | 8/2015 |

(Continued)

OTHER PUBLICATIONS

International Search Report for PCT/KR2016/013758, dated Feb. 10, 2017 and its English translation.

*Primary Examiner* — Graham P Smith
*Assistant Examiner* — Jae K Kim
(74) *Attorney, Agent, or Firm* — Seung Ho Lee

(57) ABSTRACT

Provided, as a multi-divisional antenna, in the present disclosure, is a canister antenna having a plurality of divided antennas arranged so as to have an integrated appearance. The antennas are fixed to an adapter with strong tension by using a connection member such as a wire. The multi-divisional antenna according to the present disclosure is solid, low cost, and convenient with respect to manufacturing, installation, and maintenance.

15 Claims, 11 Drawing Sheets

(56) References Cited

U.S. PATENT DOCUMENTS

| | | | | |
|---|---|---|---|---|
| 2006/0206246 | A1* | 9/2006 | Walker | G06Q 10/00 701/16 |
| 2011/0285605 | A1 | 11/2011 | Angseryd | |
| 2013/0341053 | A1* | 12/2013 | Rouse | A62C 3/006 169/23 |
| 2014/0240193 | A1 | 8/2014 | Caldwell et al. | |
| 2016/0326819 | A1* | 11/2016 | Turley | E21B 33/13 |
| 2016/0365624 | A1* | 12/2016 | Maley | H01Q 21/0006 |
| 2018/0159230 | A1* | 6/2018 | Henry | H01Q 25/007 |

FOREIGN PATENT DOCUMENTS

| | | | |
|---|---|---|---|
| KR | 10-2002-0028751 | A | 4/2002 |
| KR | 10-2003-0009910 | A | 2/2003 |
| KR | 10-2003-0019736 | A | 3/2003 |

* cited by examiner

MULTI-DIVISIONAL ANTENNA

CROSS-REFERENCE TO RELATED APPLICATIONS

This application is a Continuation of International Application No. PCT/KR2016/013758, filed on Nov. 28, 2016, which claims the benefit of and priority to Korean Patent Application No. 10-2015-0168939, filed on Nov. 30, 2015, the content of which are herein incorporated by reference in their entirety.

TECHNICAL FIELD

The present disclosure relates to a multi-divisional antenna.

BACKGROUND ART

The contents described in this section merely provide background information on the present embodiment and do not constitute the related art.

Recently, various studies have been carried out to satisfy demands for miniaturization and weight reduction of antennas which are widely used as base stations and repeaters in mobile communication. This is a way not only to reduce a physical burden on an antenna tower but also to resolve a visual barrier of an urban environment. Specifically, downtown buildings or small towers may recently become visual barriers of the urban environment and thus there is a probability for the downtown buildings or small towers acting as hindrance factors for establishing communication networks of carriers in the future.

FIG. 1A is a diagram illustrating a state in which an antenna tower, which is currently and widely used, is installed. Three mast type divisional antennas 1*a*', 1*b*', and 1*c*' are installed to branch about a center of an antenna post 1'. Each of the mast antennas 1*a*', 1*b*', and 1*c*' is formed in a plate shape and is configured to receive a signal wave in the range of 120 degrees. Since this related art is completely separated by a plate-shaped structure, there are disadvantages in that integrity of the structure is not secured so that high cost is required for maintenance and visual aesthetics of the urban environment are degraded.

Recently, in order to resolve the above-described problem, a technique for installing three antennas at single pole or tower and covering a cylindrical canister on the three antennas to conceal the three antennas has been developed.

For example, FIG. 1B illustrates a concealed type antenna tower disclosed in U. S. Patent Application Publication No. 2014/0240193 filed by "TowerCo Staffing, Inc." A concealed type antenna pole 10' has an antenna canister 15' installed at a pole 10*b*'. The antenna canister 15' has a cylindrical shape.

As shown in FIG. 17 of the above-described U. S. Patent Application Publication, the technique of FIG. 1B employs a method in which a bracket connection structure is usually provided at a central support passing through a canister to install three antennas with a predetermined angle.

However, there is an advantage in which the exterior appearance according to such a related art is well harmonized with an urban environment, but since all inner structures of the antenna canister 15' are assembled and then the antenna canister 15' should be installed at the pole 10*b*', there is a disadvantage in that installation work is difficult and, when a failure occurs, an antenna canister 15' should be disassembled and repaired. Further, since the canister 15' should be separately manufactured, production cost increases there are disadvantages in that an entire size of an antenna is increased and a weight thereof is increased.

Furthermore, since an antenna is sensitive to the influence of wind and climate at a high ground level, even when there is the influence of a strong wind or a typhoon, high-performance may be maintained only when a reception range of each of signal waves is stable. However, there is a room for the concealed type antenna pole 10' of FIG. 1B to be improved in rigidity of the connection structure between antennas.

On the basis of the recognition of the above-described problems, the applicant knows that, when multi-divisional antennas are used and improved to be integrated, the above-described disadvantages of the related art can be resolved as well as assembly, installation, and maintenance of the multi-divisional antennas can be facilitated, a connection structure between the multi-divisional antennas semi-permanently and strongly maintained, and improvement in the multi-divisional antennas can contribute to the visual aesthetics of the urban environment.

The description of the present disclosure will be made below on the basis of such knowledge.

DISCLOSURE

Technical Problem

It is an objective of the present disclosure to provide a multi-divisional antenna capable of being facilitated in assembly, installation, and maintenance, semi-permanently and strongly maintaining a connection structure between the multi-divisional antennas, contributing to visual aesthetics of an urban environment.

Another objective of the present disclosure to provide a multi-divisional antenna capable of being advantageous in terms of miniaturization and weight reduction and reducing costs with a compact structure.

Technical Solution

According to one aspect of the present invention, there is provided a multi-divisional antenna including at least three divisional antennas arranged to form a canister, and an adapter coupled to a lower surface of each of the at least three divisional antennas.

According to another aspect of the present invention, there is provided a multi-divisional antenna including a first antenna, a second antenna, and a third antenna, wherein the first, second, and third antennas are arranged to form a canister, the multi-divisional antenna includes an adapter configured to be coupled to a lower surface of each of the first, second, and third antennas, each of the first, second, and third antennas has a hollow shape and a connection fixer formed therein, an adapter-side connection fixer is formed on an upper surface of the adapter, and each of the connection fixers of the first, second and third antennas and the adapter-side connection fixer are connected and fixed by a connecting member.

According to still another aspect of the present invention, there is provided a method for installing a multi-divisional antenna, the method including providing at least three divisional antennas, coupling an adapter and a pole of the multi-divisional antenna, and coupling each of the at least three divisional antennas and the adapter using a connecting member.

According to an embodiment of the present disclosure, the connecting member may be preferably a wire.

The wire may be applied to adjust tension and to strongly fix each of the at least three divisional antennas to the adapter.

Advantageous Effects

In accordance with embodiments of the present disclosure, a cylindrical canister type antenna can be provided through an integrated structure of divisional antennas so that an effect harmonized with visual aesthetics of the city can exhibit.

Further, in accordance with embodiments of the present disclosure, manufacturing, installation, and maintenance can be facilitated and it can be advantageous in terms of miniaturization and weight reduction.

Furthermore, in accordance with embodiments of the present disclosure, there is an effect capable of providing a multi-divisional antenna which can be semi-permanently used through a rigid engagement structure using wires as connecting members.

BEST MODE

Figure 1A:
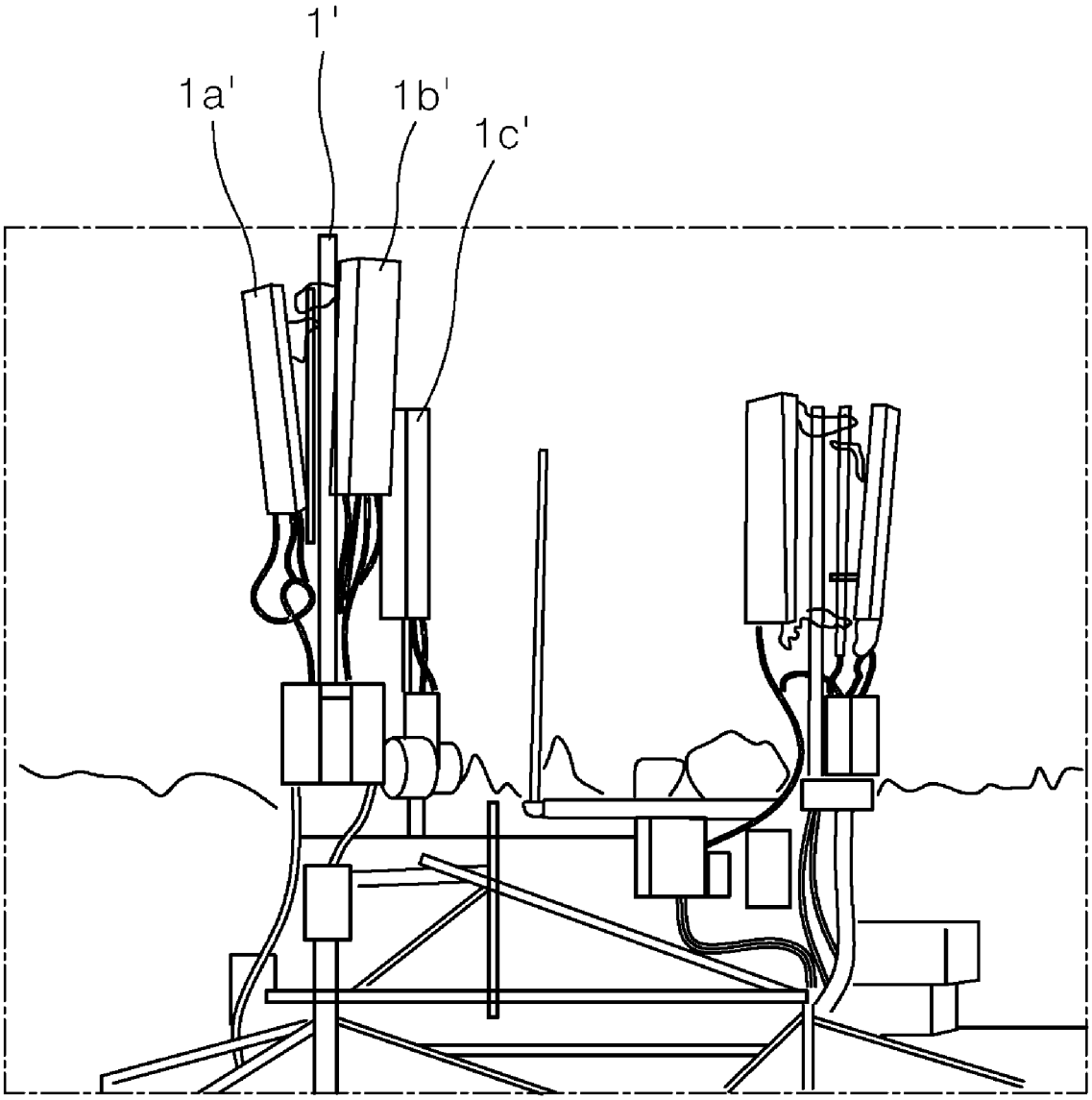
FIG. 1A is a diagram illustrating a mast type antenna of a related art.
Figure 1B:
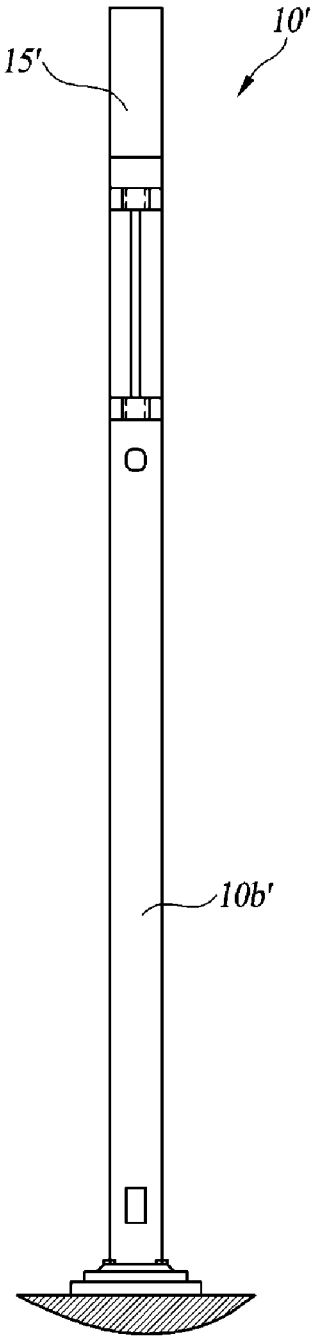
FIG. 1B is a diagram illustrating a concealed type antenna of another related art.

Hereinafter, some embodiments of the present disclosure will be described in detail with reference to the illustrative drawings. In giving reference numerals to components of the drawings, the same reference numerals are given to the same components even though the same components are shown in different drawings. Further, in the following description of the present disclosure, if a detailed description of related known configurations or functions is determined to obscure the gist of the present disclosure, the detailed description thereof will be omitted.

Furthermore, in describing components of embodiments of the present disclosure, the terms a first, a second, A, B, and the like can be used. These terms are intended to distinguish one component from other components, but the nature and the order of the components is not limited by those terms. Throughout this disclosure, when an element is referred to as "comprising" or "having" a component, it refers that the element can further include other components, not excluding the other components unless specifically stated otherwise.

When components are disclosed as being "connected to," "coupled to," or "engaged with" other components, the component can be directly connected or connected to the other components, but it should be understood that another component (s) could be "connected," "coupled," or "engaged" therebetween.

For clarity and convenience of explanation, a size, a shape, and the like of a component shown in the drawings may be exaggerated. Further, terms specifically defined in consideration of a configuration and an operation of the present disclosure are intended to only describe the embodiments of the present disclosure and are not intended to limit the scope of the present disclosure.

Hereinafter, a multi-divisional antenna 1 provided as an embodiment of the present disclosure will be described with reference to the accompanying drawings.

Figure 2:
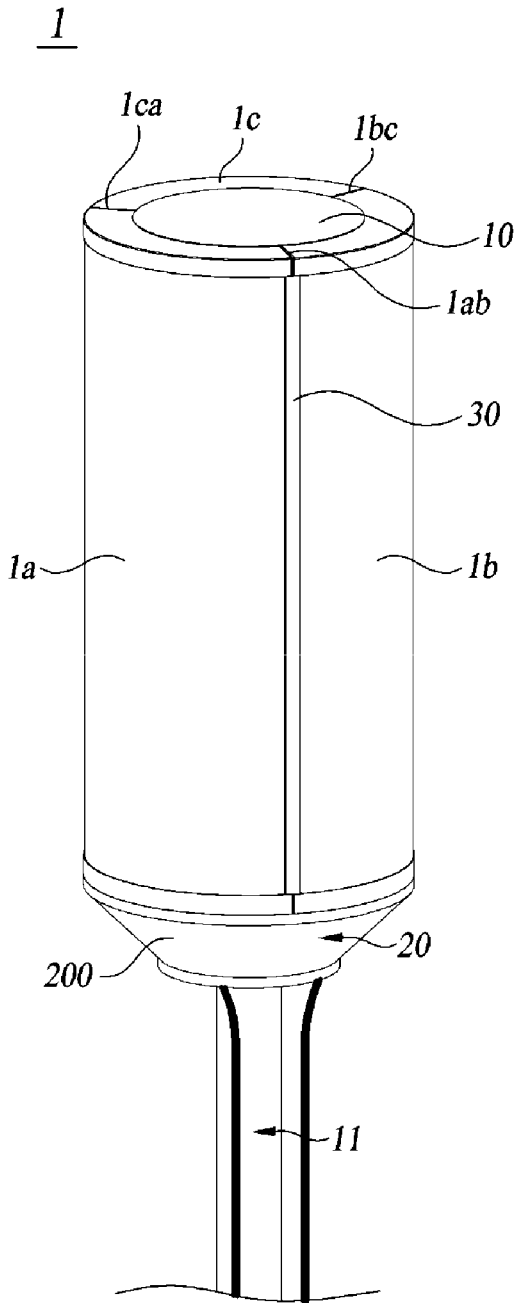
FIG. 2 is a perspective view of a multi-divisional antenna according to an embodiment of the present disclosure.

In FIG. 2, the multi-divisional antenna 1 of the present disclosure includes a first antenna 1*a*, a second antenna 1*b*, and a third antenna 1*c*. The antennas 1*a*, 1*b*, and 1*c* have the same shape and manage signal wave bands in the range of approximately 120 degrees. The antenna 1*a*, 1*b*, or 1*c* has a shape occupying one of three sector which are equally divided from an imaginary circular column. In this case, each of the antennas 1*a*, 1*b*, and 1*c* may be a member extending from a substantially fan-shaped cross section.

Boundary lines 1*ab*, 1*bc*, and 1*ca* are formed between the antennas 1*a*, 1*b*, and 1*c* on a top surface of the multi-divisional antenna 1. For example, a filler 30 such as a plastic sealing material is interposed between the antennas 1*a*, 1*b* and 1*c* below the boundary lines 1*ab*, 1*bc*, and 1*ca* to protect the multi-divisional antenna 1 from the outside and to tightly seal the multi-divisional antenna 1. It is preferable that the filler 30 forms a uniform surface relative to an outer surface of each of the antennas 1*a*, 1*b*, and 1*c* so as to provide an integral appearance of the antennas.

FIG. 2 illustrates an example of a hollow type of the multi-divisional antenna 1 of the present disclosure, and when the antennas 1*a*, 1*b*, and 1*c* are coupled to each other, an empty space is formed inside the multi-divisional antenna 1, and a cap 10 is installed to cover the empty space. The cap 10 is preferably coupled to be seen as a substantially uniform one surface relative to the upper surface of each of the antennas 1*a*, 1*b*, and 1*c*. Further, the empty space and the cap 10 may be a circular shape but are not necessarily limited thereto.

Alternatively, the multi-divisional antenna 1 of the present disclosure may be a solid shape. In this case, when the antennas 1*a*, 1*b*, and 1*c* are coupled to each other, an empty space is formed inside the multi-divisional antenna 1, and thus the cap 10 may not be required.

The multi-divisional antenna 1 of the present disclosure is characterized by providing a cylindrical canister type antenna as a structure configured with a first antenna 1*a*, a second antenna 1*b*, and a third antenna 1*c*. Accordingly, it is possible to provide an antenna structure harmonized with visual aesthetics of the surrounding urban environment while resolving a problem of an increase in size and cost due to provision of a separate canister. When a separate canister is installed to cover the antenna, a total diameter may be in the range of 1.5 m to 2 m. However, since the multi-divisional antenna 1 of the present disclosure may be reduced to a diameter to about 1 m, the multi-divisional antenna 1 is advantageous in terms of miniaturization and weight reduction eight and is easy to install.

As long as such a function is achieved, it is apparent that the multi-divisional antenna of the present disclosure is not limited to a three sector antenna structure. For example, it is possible to manufacture a divisional type antenna divided into 4 sectors, 6 sectors, . . . , or n sectors. When the multi-divisional antenna is a 6-sector type antenna, each antenna may manage a signal wave in the range of about 60 degrees.

For example, various modifications may be possible by interposing a connection structure for connecting the antennas 1*a*, 1*b*, and 1*c* or adding a dummy for external sealing at boundaries of the antennas 1*a*, 1*b*, and 1*c*.

Referring back to FIG. 2, the multi-divisional antenna 1 of the present disclosure further includes an adapter 20 connected to bottom surfaces of the first antenna 1*a*, the second antenna 1*b*, and the third antenna 1*c*. The adapter 20 has a conical shape of which a diameter is reduced downward, but it is not limited thereto. A reference numeral 200 is a protective cover 200 for protecting an internal configuration of the adapter 20 from the outside.

The multi-divisional antenna 1 is installed at a pole 11. The pole 11 is merely an example, and it may be any rod or post such as an indoor or outdoor tower, flagpole, or the like.

Figure 3A:
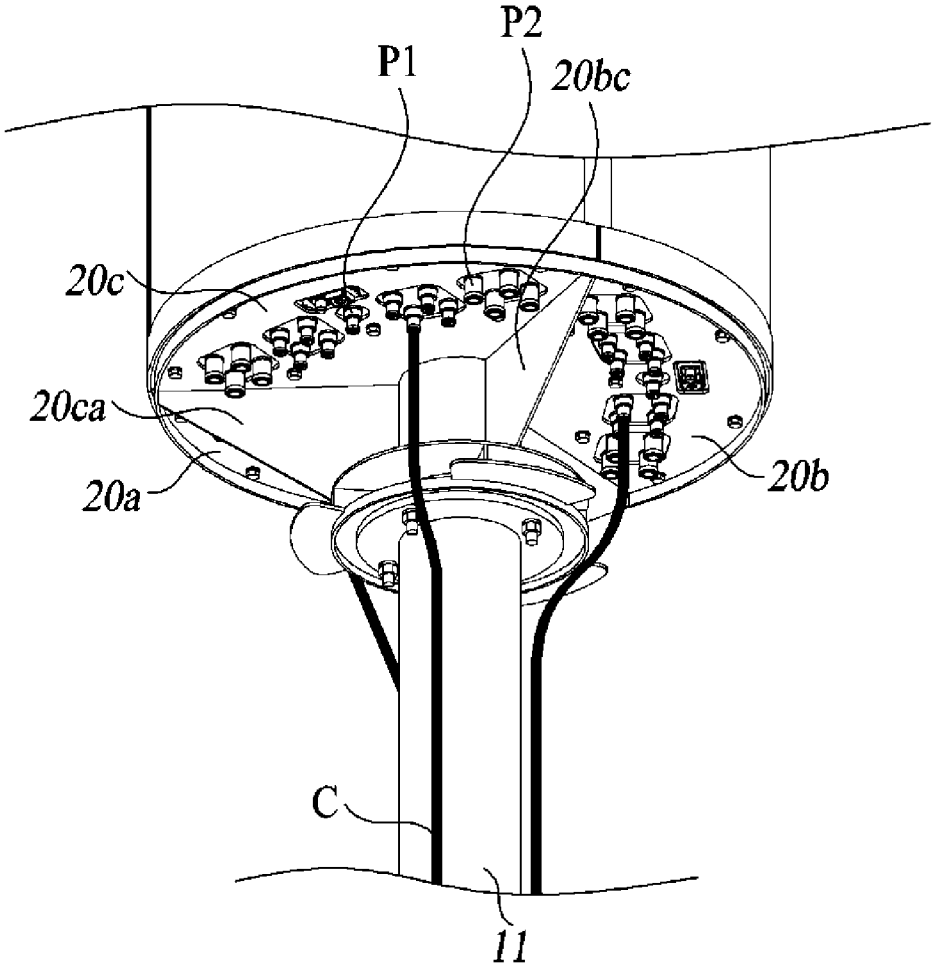
FIG. 3A is a perspective view illustrating a state in which a protective cover of an adapter according to an embodiment of the present disclosure is disassembled when viewed upward.

FIG. 3A is a perspective view illustrating a state in which the protective cover 200 of the adapter 20 of the present disclosure is disassembled when viewed upward.

The adapter 20 is divided into three regions, i.e., a first region 20*a*, a second region 20*b*, and a third region 20*c* for installing each of the antennas according to the structure of the multi-divisional antenna 1, and the first region 20*a*, the second region 20*b*, and the third region 20*c* are defined by separation plates 20*ab*, 20*bc*, and 20*ca* having triangular shapes.

A plurality of small-diameter terminals or ports P1 and a plurality of large-diameter terminals or ports P2 are formed at the antennas 1*a*, 1*b*, and 1*c* to protrude toward the regions 20*a*, 20*b*, and 20*c*. The plurality of ports P1 and P2 form connectors of the antennas and are connected to a radio frequency (RF) jumper and/or an antenna interface standards group (AISG) cable C extending through the pole 11. As is known to those skilled in the art, the plurality of ports P1 and P2 are divided and arranged according to frequency ranges, e.g., 817 to 869 MHz, 1860 to 1945 MHz, and 2490 to 2890 MHz, and corresponding jumpers or cables C are respectively coupled to the ports P1 and P2.

Figure 3B:
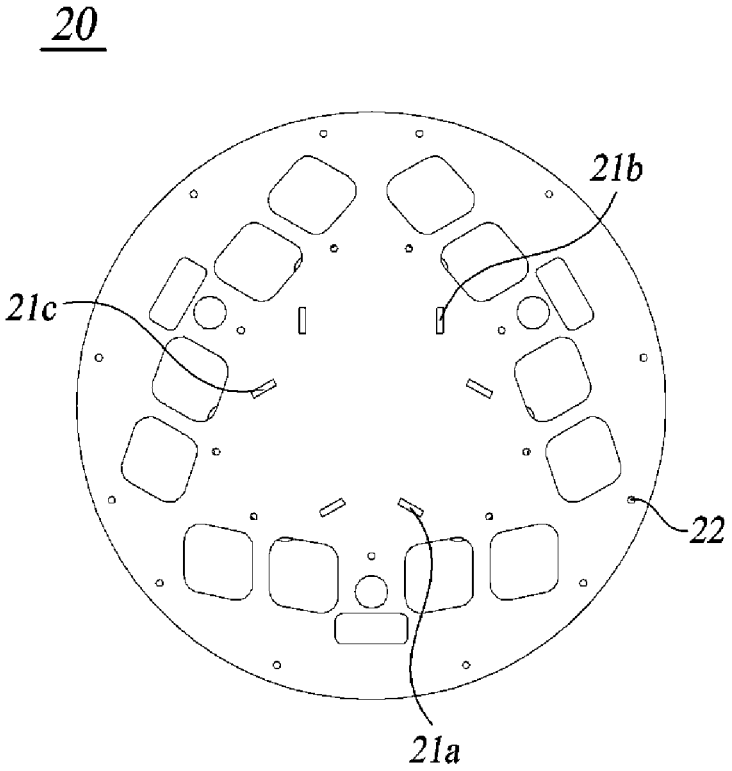
FIG. 3B is a perspective view of the adapter according to the embodiment of the present disclosure when viewed downward.
Figure 3C:
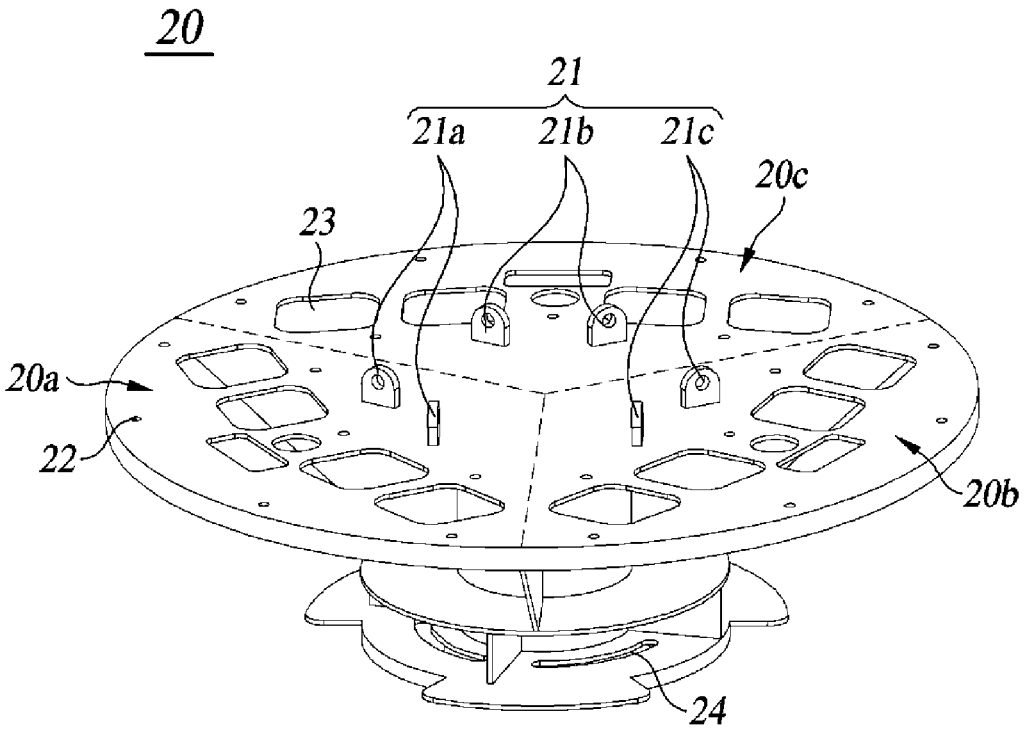
FIG. 3C is a plan view of the adapter.

FIG. 3B is a perspective view of the adapter 20 of the present disclosure when viewed downward, and FIG. 3C is a plan view of the adapter 20.

The adapter 20 forms a plurality of slots 23 arranged around the region 20*a*, 20*b*, or 20*c* in which the antenna is installed. The plurality of slots 23 are openings for receiving the plurality of ports P1 and P2 of the antenna. For example, six slots 23 are installed in each of the antenna installation regions 20*a*, 20*b*, and 20*c*, and thus eighteen slots 23 in total are installed therein, but the number and shape of the slot 23 may be arbitrarily varied according to the specifications.

The adapter 20 of the present disclosure forms a connection fixer 21 configured to assemble the antenna. The connection fixer 21 is integrally manufactured on an upper surface of the adapter 20, preferably with the adapter 20, in the form of a semicircular flange having a hole formed thereat. In the illustrated example, the connection fixer 21 includes a pair of connection fixers 21*a*, 21*a*, and 21*b* disposed in parallel between a front side of each of the plurality of slots 23 and a center of the adapter 20 in the antenna installation regions 20*a*, 20*b*, and 21*b*. Since the connection fixers formed in the same antenna installation region are formed as a pair, a distance between the connection fixers is smaller than a distance from the other connection fixers.

This is merely an example, and shapes and the number of the connection fixers 21 may be arbitrarily varied according to the antenna installation regions 20*a*, 20*b*, and 20*c*.

Further, it is possible to arrange the connection fixers 21 around the upper surface of the adapter 20 without any difference in the antenna installation regions 20*a*, 20*b*, and 20*c* at the same interval.

Coupling holes 22 are formed at an outer circumferential end of the adapter 20 at a predetermined interval. The coupling holes 22 provide openings for engaging the antennas 1*a*, 1*b*, and 1*c* at the adapter 20. Any engagement part, such as a bolt, a nut, a washer, or the like, through each of the coupling holes 22 may be appropriately selected. Alternatively, an engagement by welding may be possible without the coupling holes 22.

For example, an undescribed reference numeral 24 is a slot for providing an opening which is bolt-nut engaged with the pole 11.

In order to provide the multi-divisional antenna 1 harmonized with the urban environment, divisional antennas should be closely arranged with each other to form a canister without discrepancy. To achieve the foregoing, it is necessary that each of the antennas is semi-permanently and strongly engaged with the adapter.

Figure 4:
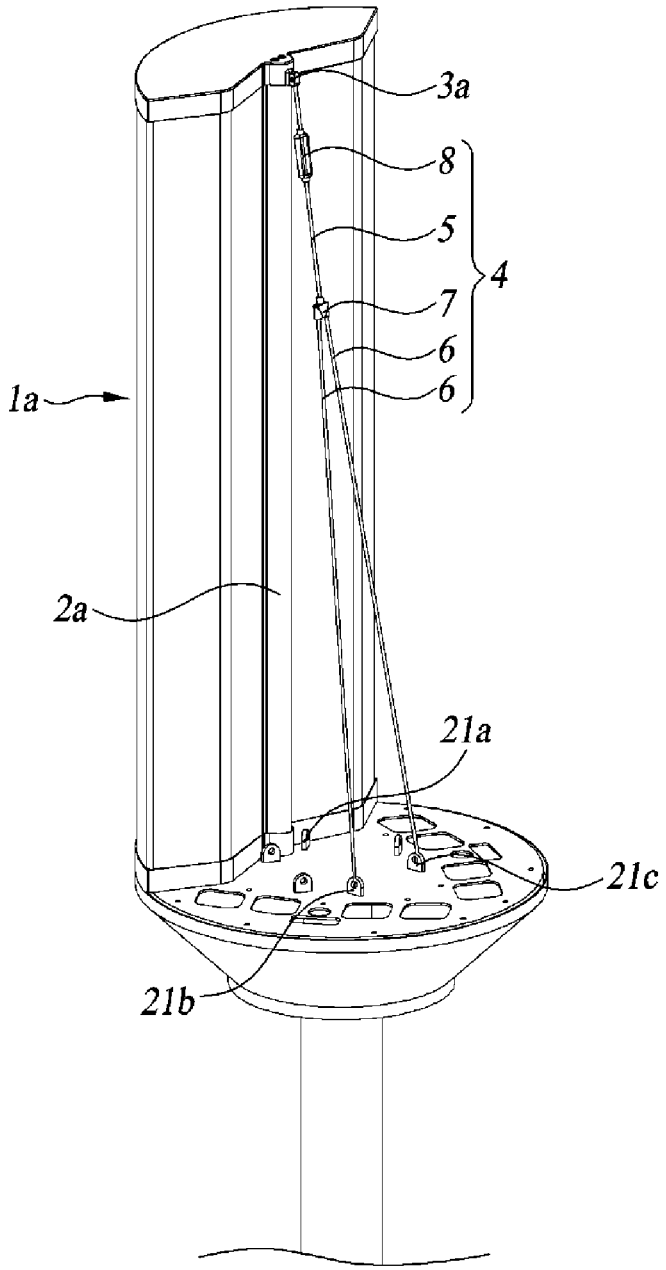
FIG. 4 is a perspective view illustrating a state in which a first antenna of the multi-divisional antenna according to the embodiment of the present disclosure is coupled to the adapter.

FIG. 4 is a perspective view illustrating a state in which each of the antennas of the multi-divisional antenna 1 of the present disclosure is coupled to the adapter 20. For convenience of illustration, the first antenna 1*a* is described as an example, and the same method is applied to the second and third antennas 1*b* and 1*c*.

The first antenna 1*a* is a hollow shape as described above, and a post 2*a* extending long in a height direction is formed at a center of an interior of the first antenna 1*a*. A semicircular flange-shaped connection fixer 3*a* having a hole formed thereat is installed at an upper portion of the post 2*a*, e.g., around the upper portion in the example shown in the drawing. Since the post 2*a* serves as a support for the connection fixer 3*a*, the post 2*a* may be omitted and the connection fixer 3*a* may be directly installed at an inner surface of the first antenna 1*a*.

The connection fixer 3*a* of the first antenna 1*a* and the connection fixer 21 of the adapter 20 are strongly connected by a connecting member 4 so that the first antenna 1*a* stands perpendicularly on the upper surface of the adapter 20. Any member may be employed as long as the connecting member 4 provides strong tension, but in the present embodiment, a wire 4 will be described as an example.

The wire 4 of the present embodiment includes an upper wire 5 and a lower wire 6.

A tension regulator 8 is installed at an appropriate position of the upper wire 5, so that the first antenna 1*a* may stand vertically and correctly relative to the adapter 20 without looseness of the connection structure. For example, the tension regulator 8 may be configured by appropriately selecting one among a tension spring, a dial for adjusting tension of the tension spring, a tensioner such as a mechanical bushing, and the like.

The lower wire 6 branches from the upper wire 5 to two strands starting from a node 7, and two strands extend downward to face each other and are spaced apart from each other as they go downward. As shown in FIG. 4, one end of the lower wire 6 is fixedly connected to the connection fixer 21*b* and the other end thereof is fixedly connected to the connection fixer 21*c*. As described above, since the branching ends of the lower wire 6 are respectively fixed to the connection fixers 21*b* and 21*c* between which a relatively large separation distance is present, it is possible to assemble the first antenna 1*a* while providing a stronger tension to the first antenna 1*a*.

The reason for employing such a coupling method is that, as it is obvious to a person skilled in the art, as the wires 4 faces each other and are connected by being spaced apart from each other between an engagement member and a target engagement member, it may be advantageous for a stable coupling between the two engagement members and motion and torsion can be prevented after the coupling. Therefore, as described above, as long as this objective can be achieved, the connection structure of the wire 4 may be appropriately changed according to the arrangement of the connection fixer 21 of the adapter 20 when the arrangement is changed.

With the same method applied to the above-described first antenna 1*a*, a connecting member (not shown) of the second antenna 1*b* is fixed between the connection fixers 21*a* and 21*c*, and a connecting member of the third antenna 1*c*, which is not fixed, is fixed between the connection fixers 21*a* and 21*b*. Accordingly, the antennas 1*a*, 1*b*, and 1*c* may stand vertically relative to the adapter 20 to forma single cylindrical canister which is integrated while being divided based on the boundary lines 1*ab*, 1*bc*, and 1*ca*. Further, the antennas 1*a*, 1*b*, and 1*c* respectively occupy the antenna installation regions 20*a*, 20*b*, and 20*c* on the adapter 20.

Even in the case of a four or more sector type divisional antenna, an integrated antenna may be formed with the same method using a connection fixer and a wire.

Hereinafter, an installation process of the multi-divisional antenna 1 will be described on the basis of the above-described configuration of the multi-divisional antenna 1 of the present disclosure with reference to FIGS. 5 to 8. This is for convenience of description, and the order of the installation process may be appropriately changed according to a work environment.

Figure 5:
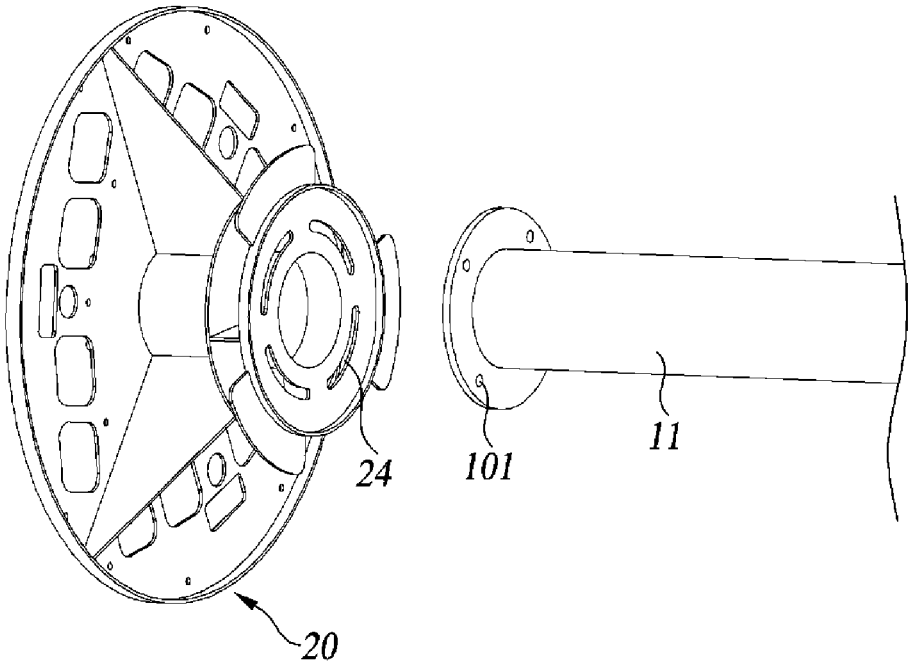
FIG. 5 is a perspective view illustrating a state in which the adapter according to the embodiment of the present disclosure is coupled to a pole.

First, as shown in FIG. 5, a coupling hole 101 formed at a flange of the pole 11 is positioned at a slot 24 of the adapter 20, and the adapter 20 and the pole 11 are aligned through, e.g., a bolt-nut coupling to complete a lower structure.

Figure 6:
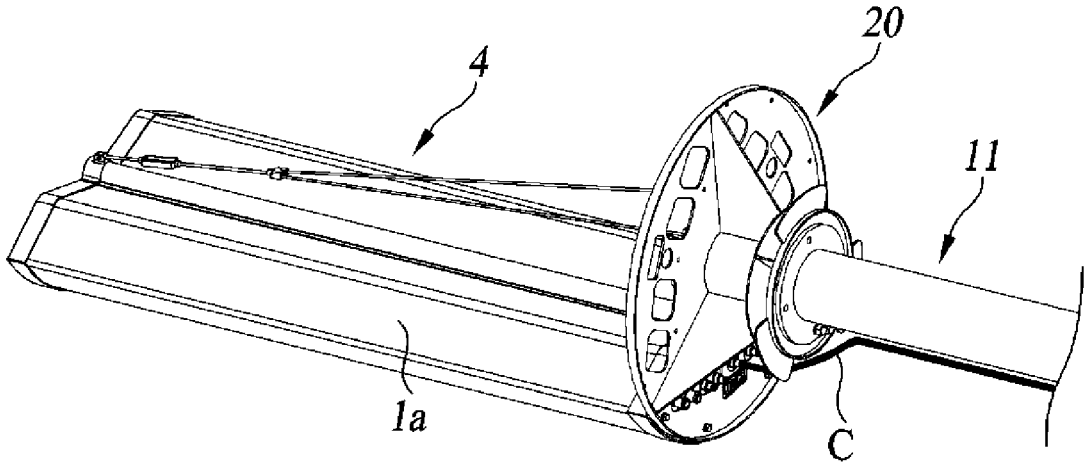
FIG. 6 is a perspective view illustrating a state in which each antenna according to the embodiment of the present disclosure is coupled to the adapter.

Next, as shown in FIG. 6, tension is adjusted and fixed using the connecting member 4 to allow the antennas 1*a*, 1*b*, and 1*c* to vertically stand relative to the adapter 20, and at this position, a connection structure between each of the antennas 1*a*, 1*b*, and 1*c* and the adapter 20 is semi-permanently and strongly engaged through the coupling holes 22, e.g., through a bolt-nut connection. Further, the jumper or cable C extending through the pole 11 is connected to terminals or the ports P1 and P2 of the antenna connectors protruding through the slots 23 to complete a communication data connection.

Figure 7:
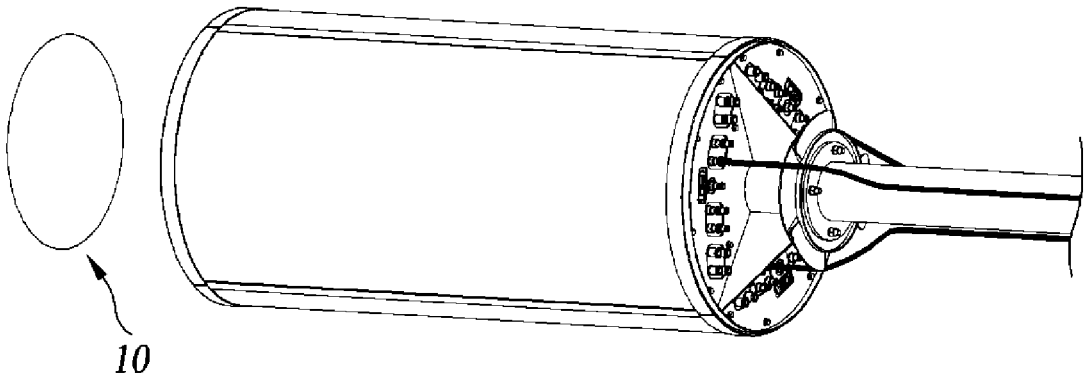
FIG. 7 is a perspective view illustrating a state in which a cap according to an embodiment of the present disclosure is coupled to each antenna.

Next, as shown in FIG. 7, the cap 10 is coupled to seal a cavity formed by the upper surfaces of the antennas 1*a*, 1*b*, and 1*c*. Any coupling method among a coupling (not shown) of a bolt and a bracket, welding with a sealing material, and the like may be appropriately selected.

Figure 8:
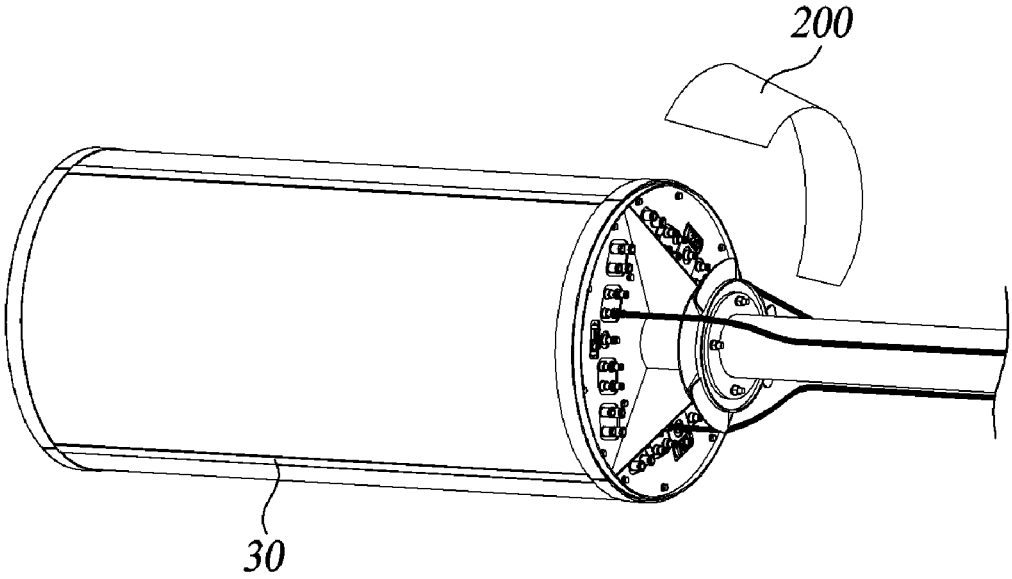
FIG. 8 is a perspective view illustrating a state in which a filler and a protective cover according to an embodiment of the present disclosure are installed at the multi-divisional antenna.

Finally, as shown in FIG. 8, the filler 30 is provided to tightly seal and protect the multi-divisional antenna 1 from the outside, and the protective cover 200 is coupled to a lower surface of the adapter 20 to complete the exterior.

The multi-divisional antenna 1 of the present invention, which is manufactured as described above, provides an antenna integrated with a cylindrical canister using the structure including the first antenna 1*a*, the second antenna 1*b*, and the third antenna 1*c*, thereby exhibiting an effect harmonized with the visual aesthetics of the city.

Further, it can be seen that a signal wave can be stably received even in a natural environment such as a strong wind or a typhoon due to the strong engagement structure using the wire, and a high performance service can always be provided to the user.

While the preferred embodiments of the present disclosure have been described with reference to the accompanying drawings, these are merely examples, and it should be understood that the present disclosure can be variously modified in shape, position, size, and arrangement without departing from the equivalent technical spirit on the basis of the embodiments. Accordingly, the scope of the present disclosure should not be limited to the specific embodiments described above, and it should be noted that the scope of protection of the present disclosure extends to the same and equivalent as the appended claims.

CROSS-REFERENCE TO RELATED APPLICATION

This patent application claims priority to Korean Patent Application No. 10-2015-0168939 filed on Nov. 30, 2015 according to U. S. Patent Law 119 (*a*) (35 U.S.C. § 119 (a)), and entire contents thereof are incorporated herein by reference. Further, this patent application claims priority to the countries other than the United States for the same reason as above, and the entire contents thereof are incorporated herein by reference.

The invention claimed is:

1. An antenna system, comprising:

at least three antennas arranged to form a canister, wherein each of the at least three antennas has a top surface and a bottom surface, and each of the at least three antennas comprises an antenna-side connecting fixer provided on an upper portion of the corresponding one of the at least three antennas; and an adapter coupled to the bottom surface of each of the at least three antennas, wherein the adaptor comprises at least three adapter-side connecting fixers provided on a top surface of the adaptor, wherein the antenna-side connecting fixer of each of the three antennas is connected to one of the at least three adapter-side connecting fixers by a wire, wherein the wire comprises an upper wire and a lower wire, the upper wire including a tension adjuster, and wherein the lower wire branches from the upper wire to at least two strands starting from a node and the at least two strands faces each other and extends downward to be spaced apart from each other.

2. The antenna system of claim 1, wherein each of the at least three divisional antennas has a hollow space.

3. The antenna system of claim 1, wherein the adapter comprises at least three regions each corresponding to one of the at least three antennas, and each of the corresponding regions comprises one of the at least three adapter-side connecting fixers.

4. The antenna system of claim 3, wherein an end of the lower wire is connected and fixed to the adapter-side connecting fixer provided on each of corresponding regions of another antenna.

5. The antenna system of claim 1, wherein each of the at least three antennas comprises a plurality of projections provided on its bottom surface, and the adaptor comprises a plurality of slots for accommodating the plurality of projections of each of the at least three antennas.

6. The antenna system of claim 5, wherein coupling holes for coupling to each of the at least three antennas are formed at the adapter in the vicinity of an outer circumferential end thereof.

7. A set of antennas, comprising:

a first antenna, a second antenna, and a third antenna, wherein the first, second, and third antennas are arranged to form a canister, wherein each of first, second and third antennas has a top surface and a bottom surface, and each of the first, second and third antennas comprises an antenna-side connecting fixer provided on an upper portion of the corresponding one of the first, second and third antennas; and an adapter configured to be coupled to the bottom surface of each of the first, second, and third antennas, wherein each of the first, second, and third antennas has a hollow space and a antenna-side connection fixer formed therein, wherein the adapter comprises an adapter-side connection fixer on a top surface of the adapter, and each of the antenna-side connection fixers of the first, second and third antennas and the adapter-side connection fixer are connected and fixed by a wire, wherein the wire comprises an upper wire and a lower wire, the upper wire including a tension adjuster, and wherein the lower wire branches from the upper wire to at least two strands starting from a node and the at least two strands faces each other and extends downward to be spaced apart from each other.

8. The antennas of claim 7, wherein the adapter comprises three regions each corresponding to one of the first, second and third antennas, and an end of the wire is connected and fixed to the adapter-side connection fixer formed in a corresponding region of another antenna.

9. The antenna system of claim 2, wherein a plurality of slots for accommodating the connectors of each of the at least three antennas are formed at the adapter.

10. The antenna system of claim 2, wherein a plurality of slots for accommodating the connectors of each of the at least three antennas are formed at the adapter.

11. The antenna system of claim 3, wherein a plurality of slots for accommodating the connectors of each of the at least three antennas are formed at the adapter.

12. The antenna system of claim 3, wherein a plurality of slots for accommodating the connectors of each of the at least three antennas are formed at the adapter.

13. The antennas claim 8, wherein the connecting wire is oriented obliquely with respect to the at least one of the three antennas.

14. The antenna system of claim 1, wherein the wire is oriented obliquely with respect to the at least three antennas.

15. The antenna system of claim 1, wherein the antenna-side connecting fixer of each of the at least three antennas is a projection having a through-hole, and the at least three adapter-side connecting fixers are projections each having a through-hole.

* * * * *